US005918860A

United States Patent [19]

Cho

[11] Patent Number: 5,918,860

[45] Date of Patent: Jul. 6, 1999

[54] UPLIFT ASSEMBLY

[76] Inventor: Chang-Sheng Cho, 58, Ma Yuan West St., Taichung, Taiwan

[21] Appl. No.: 09/092,390

[22] Filed: Jun. 5, 1998

Related U.S. Application Data

[63] Continuation-in-part of application No. 08/782,089, Jan. 13, 1997, abandoned.

[51] Int. Cl.[6] ..... B66F 1/00

[52] U.S. Cl. ..... 254/106; 254/89 H; 405/228

[58] Field of Search ..... 254/106, 45, 50.3, 254/423, 89 H, 93 R, 107, 108, 111

[56] References Cited

U.S. PATENT DOCUMENTS

| | | | |
|---|---|---|---|
| 2,830,788 | 4/1958 | Bentley et al. | 254/106 |
| 3,203,669 | 8/1965 | Johansson | 254/106 |
| 3,901,477 | 8/1975 | Ahl | 254/107 |
| 4,277,052 | 7/1981 | Kallinger | 254/106 |
| 4,367,056 | 1/1983 | Senevirate | 254/106 |
| 4,405,115 | 9/1983 | Boyadjieff | 254/106 |
| 4,411,408 | 10/1983 | Radovan et al. | 254/108 |

*Primary Examiner*—David A. Scherbel
*Assistant Examiner*—Lee Wilson

[57] ABSTRACT

An uplift assembly has a first uplifter, a second uplifter, a rod enclosed by the first uplifter and the second uplifter, a first positioning plate connected to the first uplifter, a second positioning plate connected to the second uplifter, a first clamping plate clamping the first positioning plate, a second clamping plate clamping the first positioning plate, a third clamping plate clamping the second positioning plate, a fourth clamping plate clamping the second positioning plate, a first cylinder disposed between the first clamping plate and the third clamping plate, a second cylinder disposed between the second clamping plate and the fourth clamping plate, and a base plate disposed beneath the third clamping plate, the fourth clamping plate and the second uplifter.

2 Claims, 10 Drawing Sheets

UPLIFT ASSEMBLY

The present invention is a continuation-in-part of application Ser. No. 08/782,089, filed Jan. 13, 1997, now abandoned.

BACKGROUND OF THE INVENTION

The invention relates to an uplift assembly. More particularly, the invention relates to an uplift assembly for uplifting mold plates.

A large number of mold plates are always used in a huge construction. A large factory and a high building should have many floors. The mold plates are used on a first floor. After the first floor is constructed, the mold plates are moved and placed on a second floor. The worker should disassemble the mold plates from the first floor and assemble the mold plates on the second floor. It is not convenient to disassemble the mold plates from the lower floor and assemble the mold plates on the higher floor.

SUMMARY OF THE INVENTION

An object of the invention is to provide an uplift assembly for uplifting mold plates continuously.

Accordingly, an uplift assembly has a first uplifter, a second uplifter, a rod enclosed by the first uplifter and the second uplifter, a first positioning plate connected to the first uplifter, a second positioning plate connected to the second uplifter, a first clamping plate clamping the first positioning plate, a second clamping plate clamping the first positioning plate, a third clamping plate clamping the second positioning plate, a fourth clamping plate clamping the second positioning plate, a first cylinder disposed between the first clamping plate and the third clamping plate, a second cylinder disposed between the second clamping plate and the fourth clamping plate, and a base plate disposed beneath the third clamping plate, the fourth clamping plate and the second uplifter. Each of the first and the second positioning plates has a plurality of round holes. A first annular adjustment device is disposed on the first cylinder. A second annular adjustment device is disposed on the second cylinder. Four support bars are disposed on four corners of the base plate. A top plate is disposed on the support bars. The top plate has a through hole to receive the rod. The base plate has a center hole to receive a pipe. A first shaft is disposed in the first cylinder to be connected to the first clamping plate. A second shaft is disposed in the second cylinder to be connected to the second clamping plate. The first uplifter has a first hollow barrel, a plurality of inner threads formed in an upper portion of the first hollow barrel, a tapered wall formed in a middle portion of the first hollow barrel, a plurality of internal threads formed in a lower portion of the first hollow barrel, a plurality of catch blocks disposed in an inner periphery of the first hollow barrel, a plurality of springs disposed beneath the corresponding catch blocks respectively, a ring disposed beneath the springs, and a locking seat disposed in the lower portion of the first hollow barrel to support the ring. Each of the catch blocks has a plurality of embossed stripes to clamp the rod and a tapered periphery to match the corresponding tapered wall. Each of the embossed stripes inclined downward. A plurality of positioning posts are disposed on the ring to be passed through the corresponding springs respectively and to be inserted in the corresponding catch blocks respectively. The locking seat has a collar, a plurality of through apertures, and a plurality of external threads engaging with the internal threads of the first hollow barrel. A first hollow sleeve is disposed on the first hollow barrel. The first hollow sleeve has a notched flange and a plurality of outer threads engaging with the inner threads of the first hollow barrel. The second uplifter has a first hollow barrel, a plurality of inner threads formed in an upper portion of the first hollow barrel, a tapered wall formed in a middle portion of the first hollow barrel, a plurality of internal threads formed in a lower portion of the first hollow barrel, a plurality of catch blocks disposed in an inner periphery of the first hollow barrel, a plurality of springs disposed beneath the corresponding catch blocks respectively, a ring disposed beneath the springs, and a locking seat disposed in the lower portion of the first hollow barrel to support the ring. Each of the catch blocks has a plurality of embossed stripes to clamp the rod and a tapered periphery to match the corresponding tapered wall. Each of the embossed stripes inclined downward. A plurality of positioning posts are disposed on the ring to be passed through the corresponding springs respectively and to be inserted in the corresponding catch blocks respectively. The locking seat has a collar, a plurality of through apertures, and a plurality of external threads engaging with the internal threads of the first hollow barrel. A first hollow sleeve is disposed on the first hollow barrel. The first hollow sleeve has a notched flange and a plurality of outer threads engaging with the inner threads of the first hollow barrel.

BRIEF DESCRIPTION OF THE DRAWINGS

FIG. 2 is a sectional view of a catch block;

DETAILED DESCRIPTION OF THE INVENTION

Figure 1:
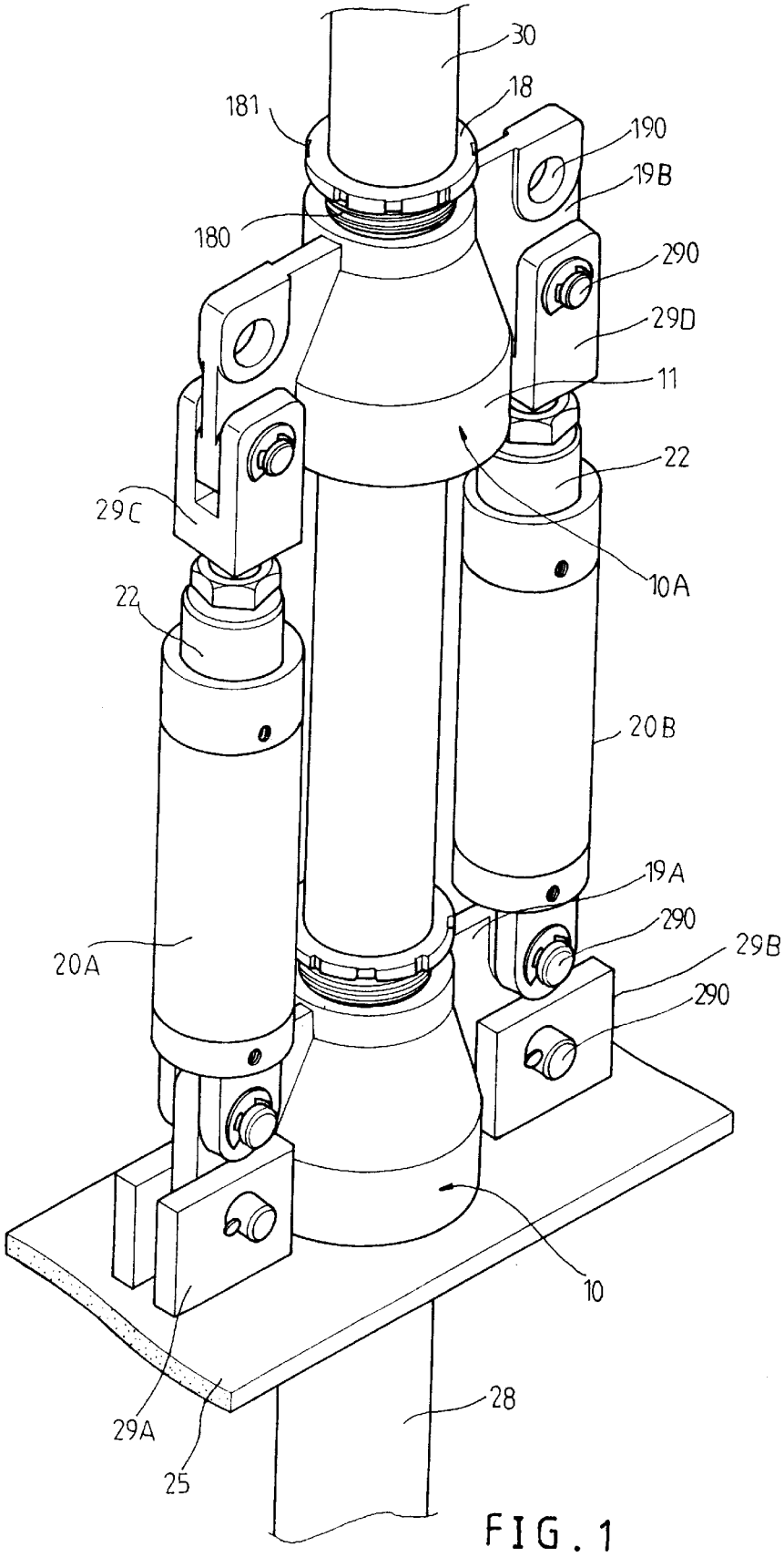
FIG. 1 is a perspective assembly view of an uplift assembly of a preferred embodiment in accordance with the present invention.
Figure 2:
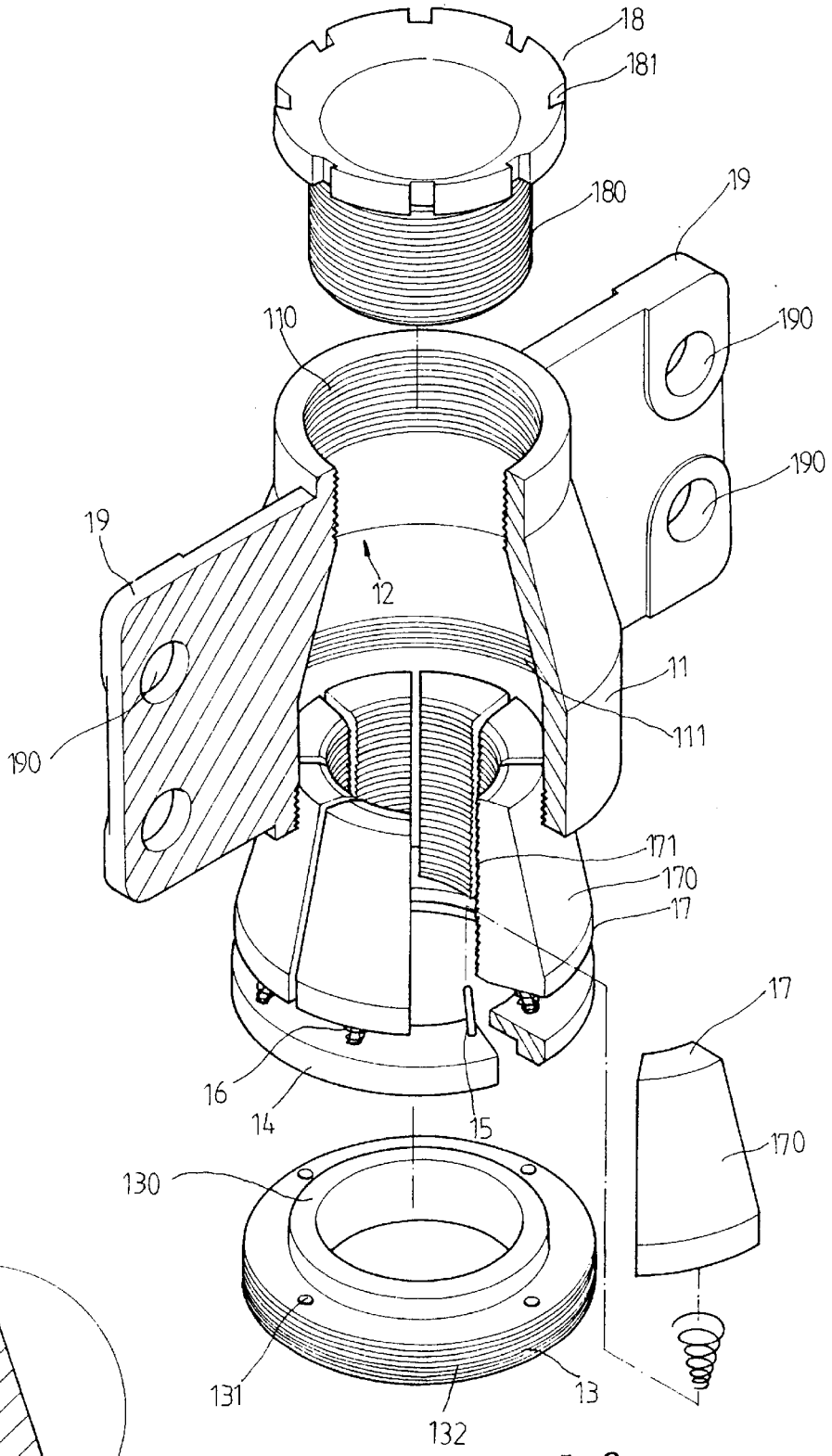
FIG. 2 perspective exploded view of an uplifter.
Figure 2A:
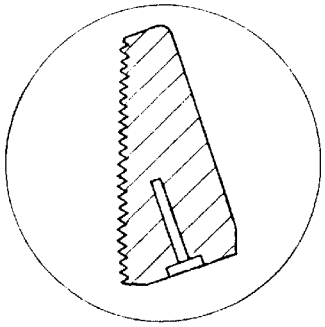
Figure 3:
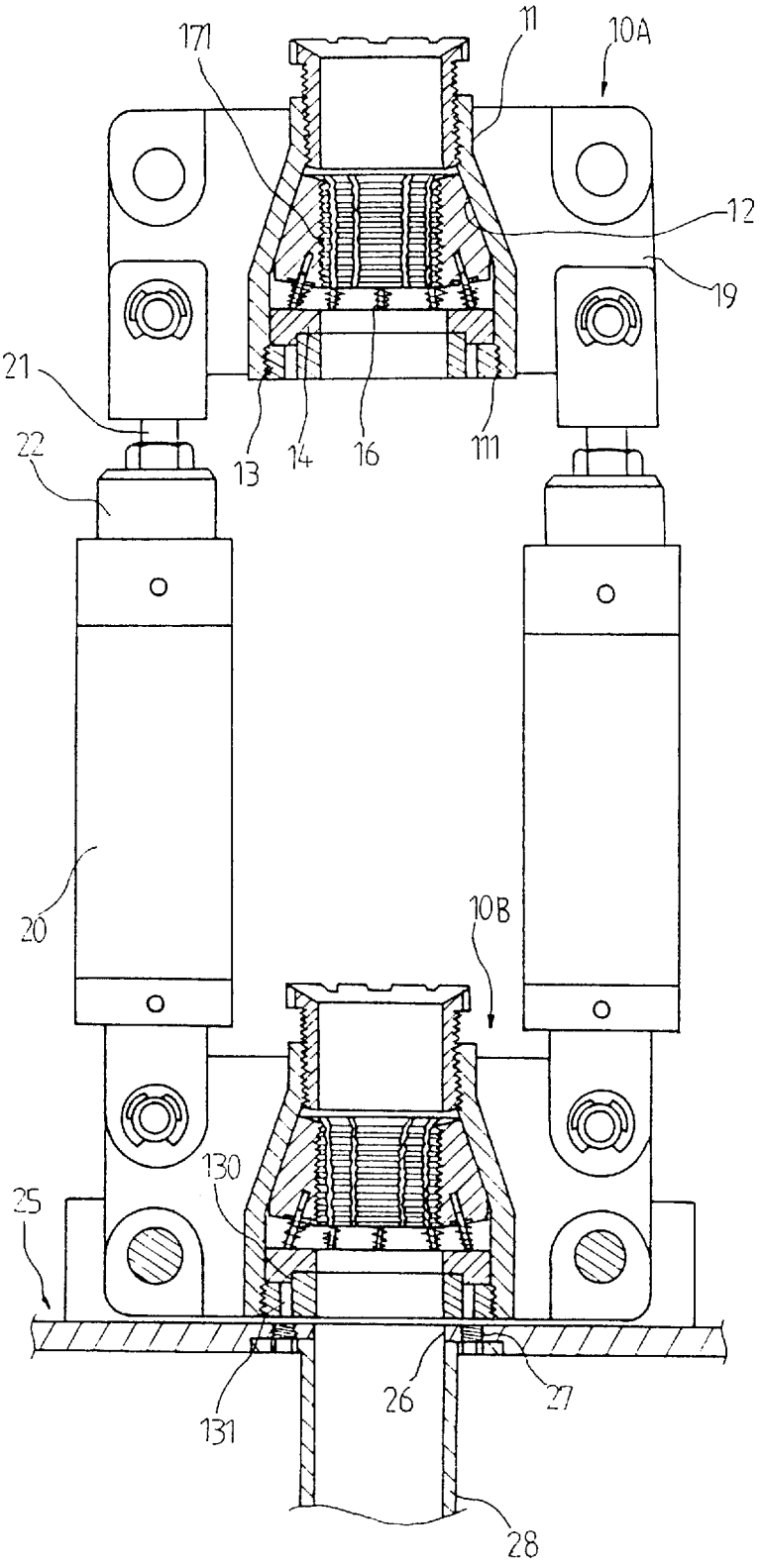
FIG. 3 is a sectional view of an uplift assembly of a preferred embodiment in accordance with the present invention.

Referring to FIGS. 1 to 4A, an uplift assembly has a first uplifter 10, a second uplifter 10A, a rod 30 enclosed by the first uplifter 10 and the second uplifter 10A, a first positioning plate 19A connected to the first uplifter 10, a second positioning plate 19B connected to the second uplifter 10A, a first clamping plate 29A clamping the first positioning plate 19A, a second clamping plate 29B clamping the first positioning plate 19A, a third clamping plate 29C clamping the second positioning plate 19B, a fourth clamping plate 29D clamping the second positioning plate 19B, a first cylinder 20A disposed between the first clamping plate 29A and the third clamping plate 29C, a second cylinder 20B disposed between the second clamping plate 29B and the fourth clamping plate 29D, and a base plate 25 disposed beneath the first clamping plate 29A, the second clamping plate 29B and the first uplifter 10. Each of the first and the second positioning plates 19A and 19B has a plurality of round holes 190. The first and the second clamping plates 29A and 29B and the first positioning plates 19A are fastened by pins 290. The third and the fourth clamping plates 29C and 29D and the second positioning plates 19B are fastened by pins 290. A first annular adjustment device 22 is disposed on the first cylinder 20A. A second annular adjustment device 22 is disposed on the second cylinder 20B. Four support bars 31 are disposed on four corners of the base plate 25. A top plate 32 is disposed on the support bars 31. The top plate 32 has a through hole 320 to receive the rod 30.

A plurality of bolts 27 fasten the second uplifter 10 on the base plate 25. The base plate 25 has a center hole 26 to receive a pipe 28. The pipe 28 is inserted in a mold plate 35. A first shaft 21 is disposed in the first cylinder 20A to be connected to the first clamping plate 29A. A second shaft 21 is disposed in the second cylinder 20B to be connected to the second clamping plate 29B.

The first uplifter 10 has a first hollow barrel 11, a plurality of inner threads 110 formed in an upper portion of the first hollow barrel 11, a tapered wall 12 formed in a middle portion of the first hollow barrel 11, a pluality of internal threads 111 formed in a lower portion of the first hollow barrel 11, a plurality of catch blocks 17 disposed in an inner periphery of the first hollow barrel 11, a plurality of springs 16 disposed beneath the corresponding catch blocks 17 respectively, a ring 14 disposed beneath the springs 16, and a locking seat 13 disposed in the lower portion of the first hollow barrel 11 to support the ring 14. Each of the catch blocks 17 has a plurality of embossed stripes 171 to clamp the rod 30 and a tapered periphery 170 to match the corresponding tapered wall 12. Each of the embossed stripes 171 inclined downward. A plurality of positioning posts 15 are disposed on the ring 14 to be passed through the corresponding springs 16 respectively and to be inserted in the corresponding catch blocks 17 respectively. The locking seat 13 has a collar 130, a plurality of through apertures 131, and a plurality of external threads 132 engaging with the internal threads 111 of the first hollow barrel 11. A first hollow sleeve 18 is disposed on the first hollow barrel 11. The first hollow sleeve 18 has a notched flange 181 and a plurality of outer threads 180 engaging with the inner threads 110 of the first hollow barrel 11.

The second uplifter 10A has a second hollow barrel 11, a plurality of inner threads 110 formed in an upper portion of the second hollow barrel 11, a tapered wall 12 formed in a middle portion of the second hollow barrel 11, a plurality of internal threads 111 formed in a lower portion of the second hollow barrel 11, a plurality of catch blocks 17 disposed in an inner periphery of the second hollow barrel 11, a plurality of springs 16 disposed beneath the corresponding catch blocks 17 respectively, a ring 14 disposed beneath the springs 16, and a locking seat 13 disposed in the lower portion of the second hollow barrel 11 to support the ring 14. Each of the catch blocks 17 has a plurality of embossed stripes 171 to clamp the rod 30 and a tapered periphery 170 to match the corresponding tapered wall 12. Each of the embossed stripes 171 inclined downward. A plurality of positioning posts 15 are disposed on the ring 14 to be passed through the corresponding springs 16 respectively and to be inserted in the corresponding catch blocks 17 respectively. The locking seat 13 has a collar 130, a plurality of through apertures 131, and a plurality of external threads 132 engaging with the internal threads 111 of the second hollow barrel 11. A second hollow sleeve 18 is disposed on the second hollow barrel 11. The second hollow sleeve 18 has a notched flange 181 and a plurality of outer threads 180 engaging with the inner threads 110 of the second hollow barrel 11.

Figure 4:
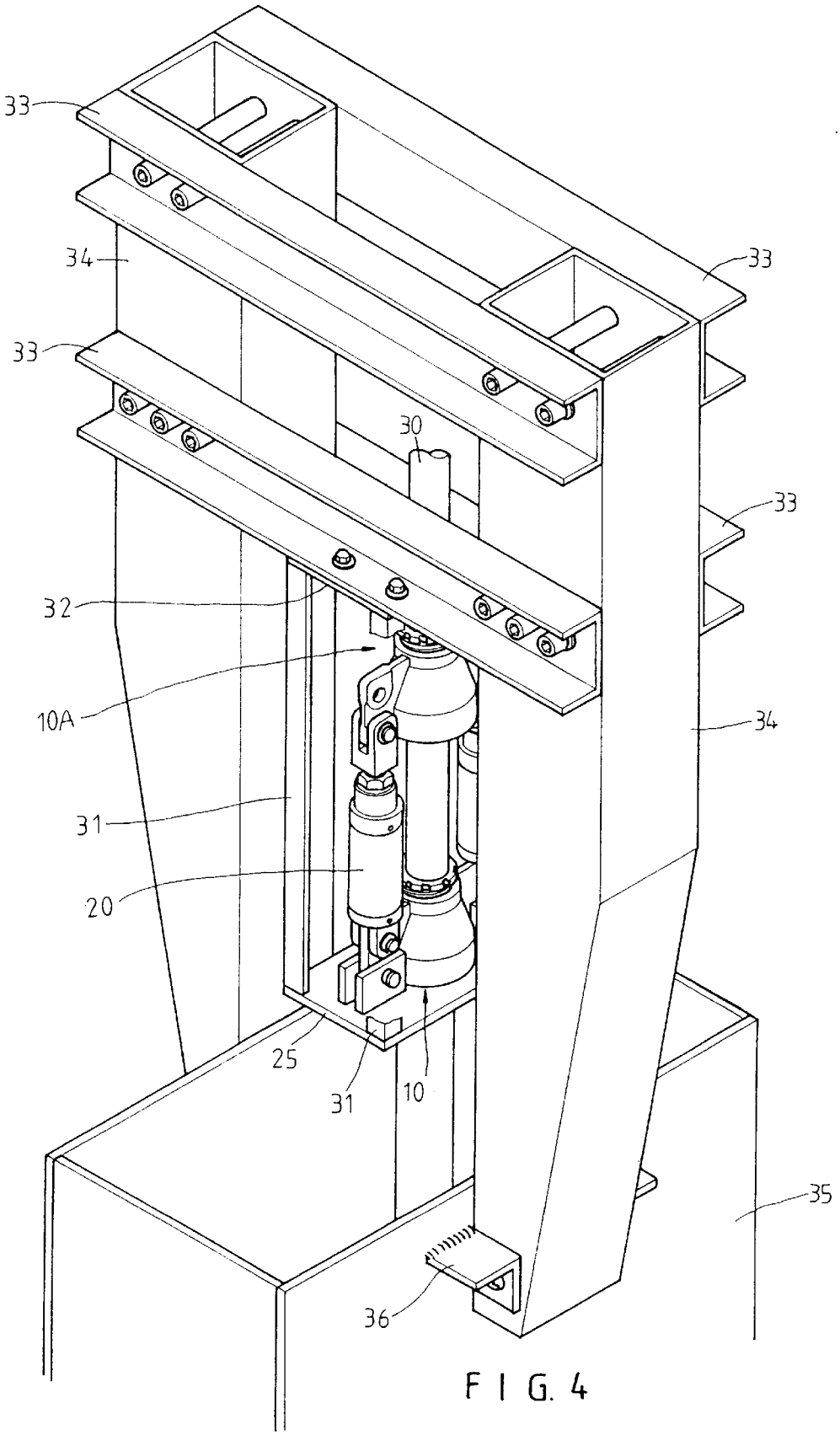
FIG. 4 is a schematic view illustrating an application of an uplift assembly.
Figure 4A:
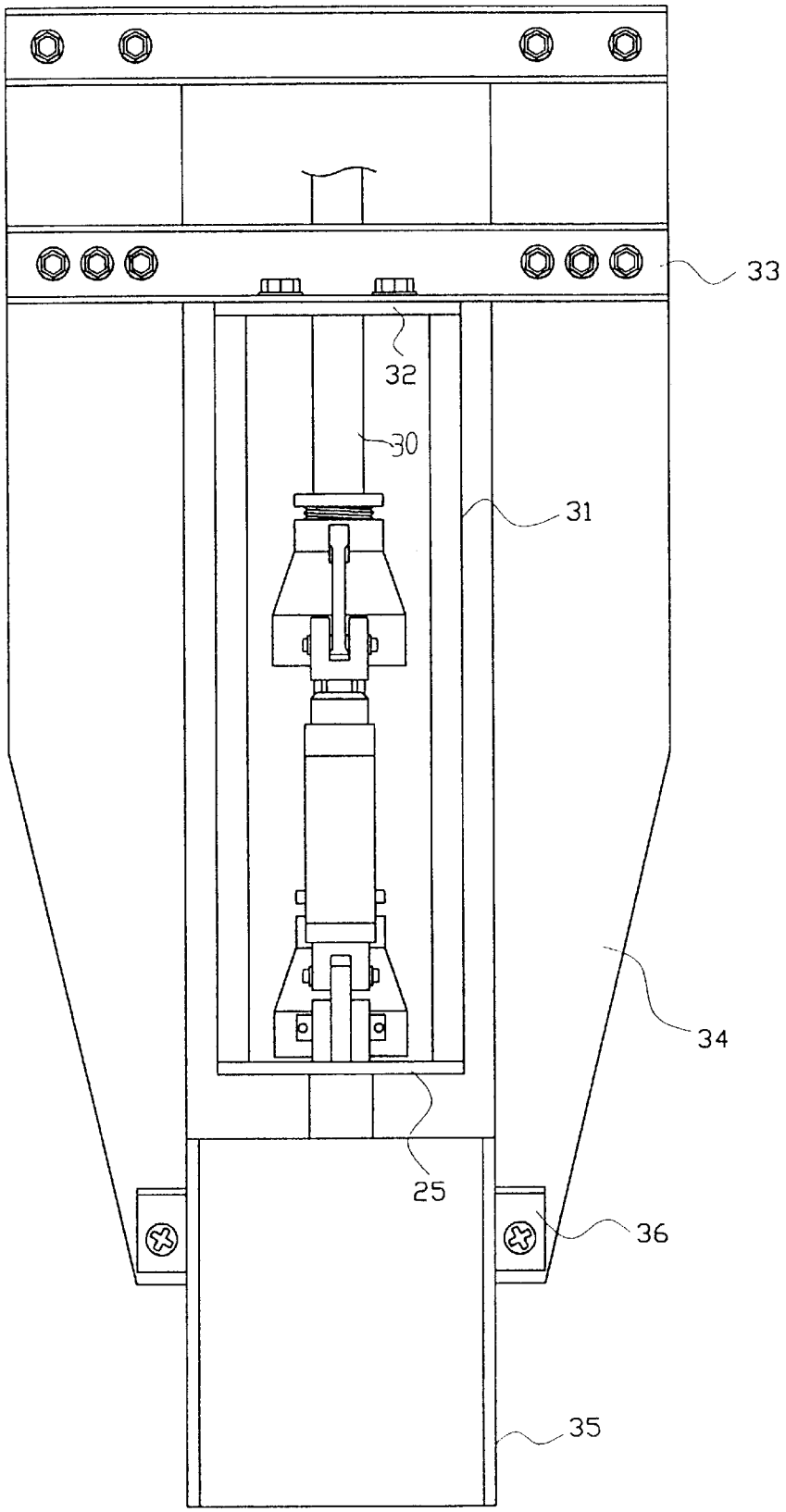
FIG. 4A is an elevational view of FIG. 4.
Figure 5:
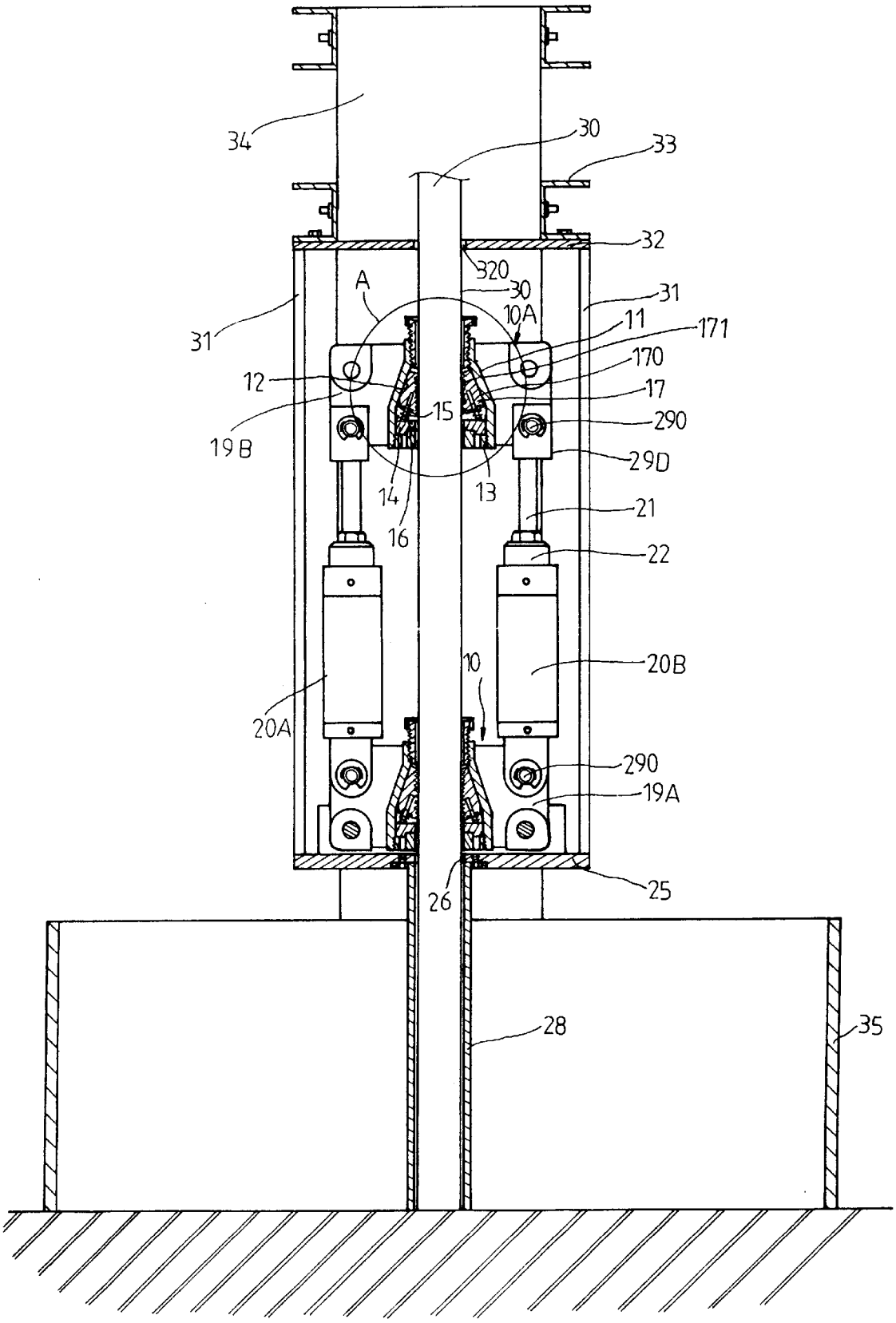
FIG. 5 is a schematic view illustrating an operation of an uplift assembly.

Referring to FIGS. 4 to 5, the mold plate 35 is clamped by two longitudinal pillars 34. A plurality of cross bars 33 are connected to two longitudinal pillars 34. The uplift assembly is positioned by two of the cross bars 33. Each of the longitudinal pillars 34 has two L-shaped plates 36.

The rod 30 is placed on the ground. The mold plate 35 is placed on the ground also. The mold plate 35 is grouted.

Figure 5A:
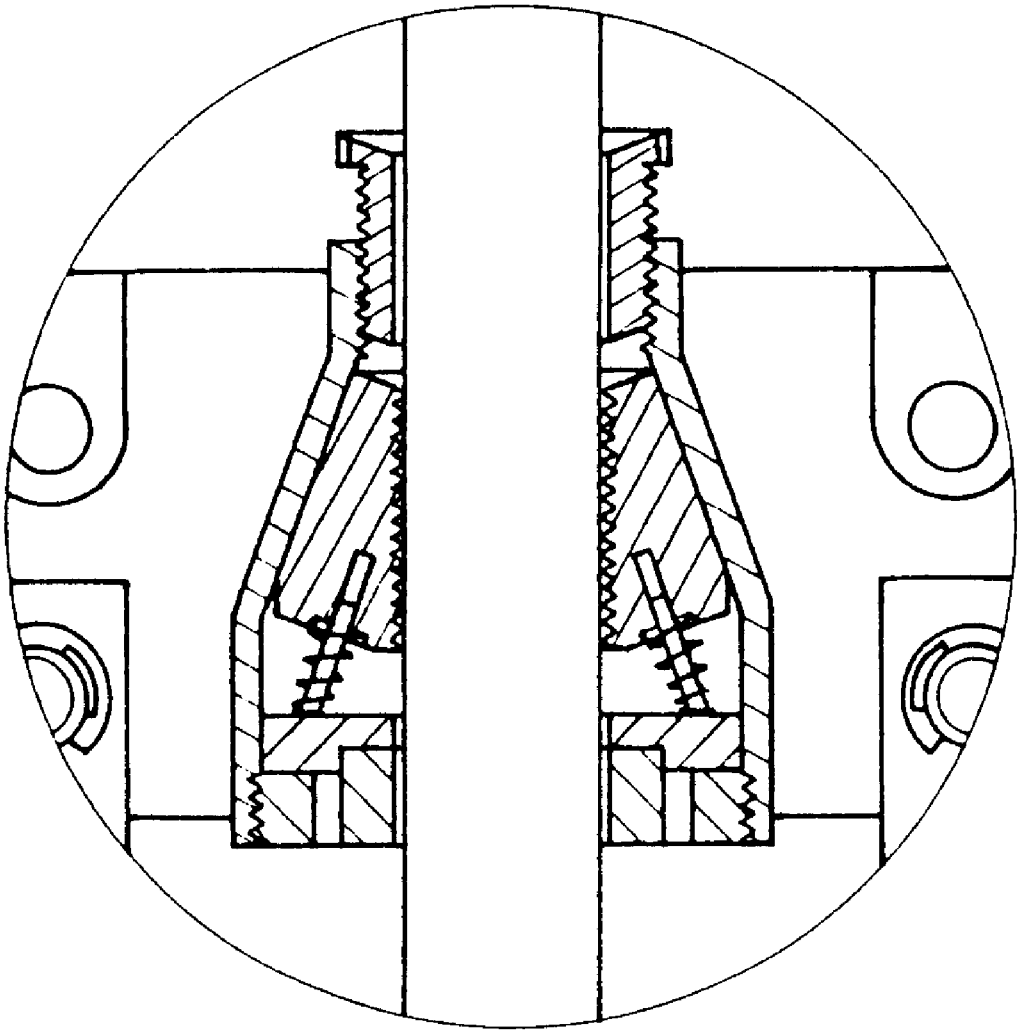
FIG. 5A is a first sectional view of a second uplifter.

Referring to FIGS. 5 and 5A, the cylinders 20 drive the shafts 21 to move upward and to drive the second uplifter 10A to ascend. The second hollow barrel 11 of the second uplifter 10A moves upward. The locking seat 13 presses the ring 14. While the second uplifter 10A moves upward, the catch blocks 17 moves downward slightly. Then the catch blocks 17 will not catch the rod 30, but the catch blocks 17 contacts the rod 30 slightly.

Figure 6:
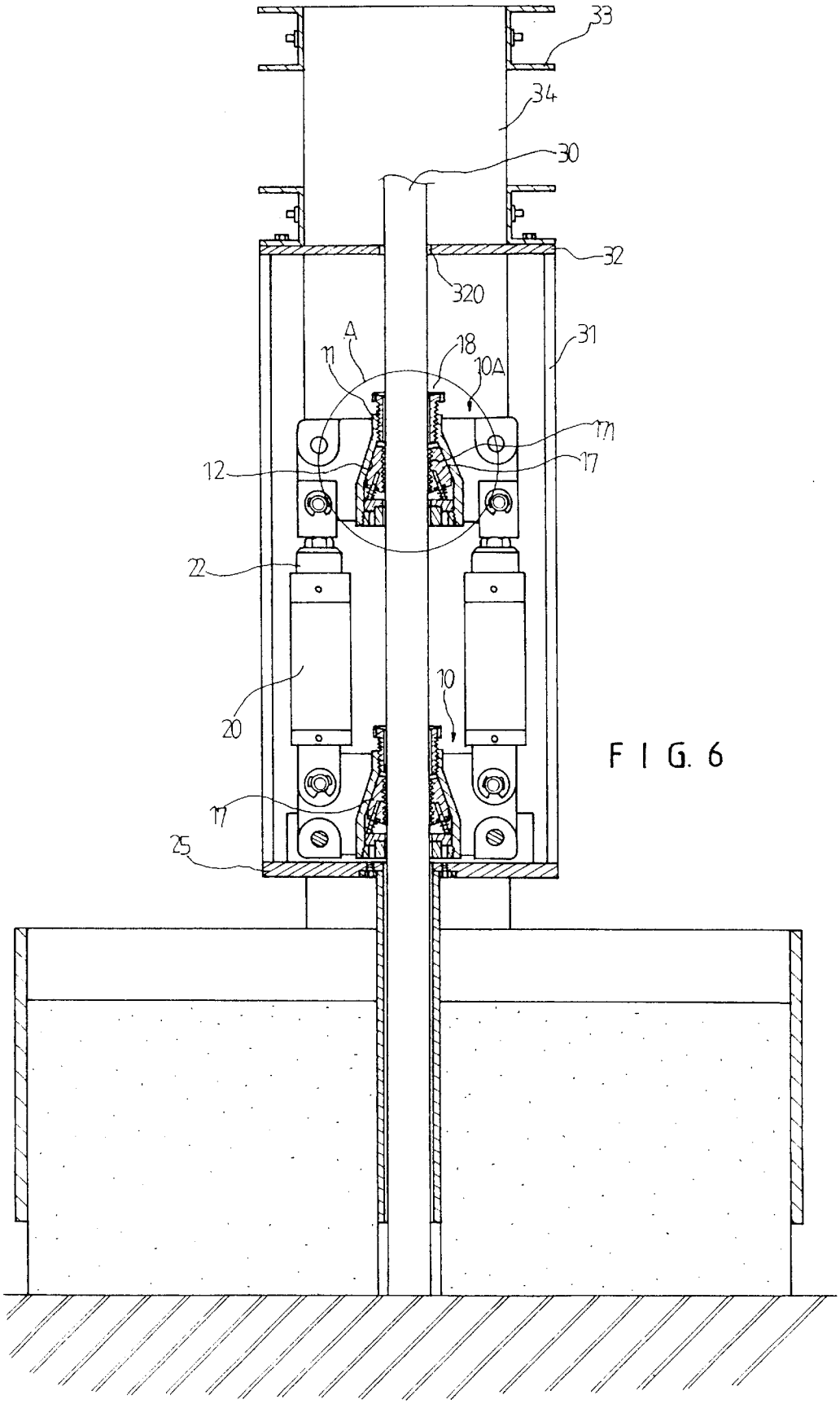
FIG. 6 is a schematic view illustrating an operation of an uplift assembly.
Figure 6A:
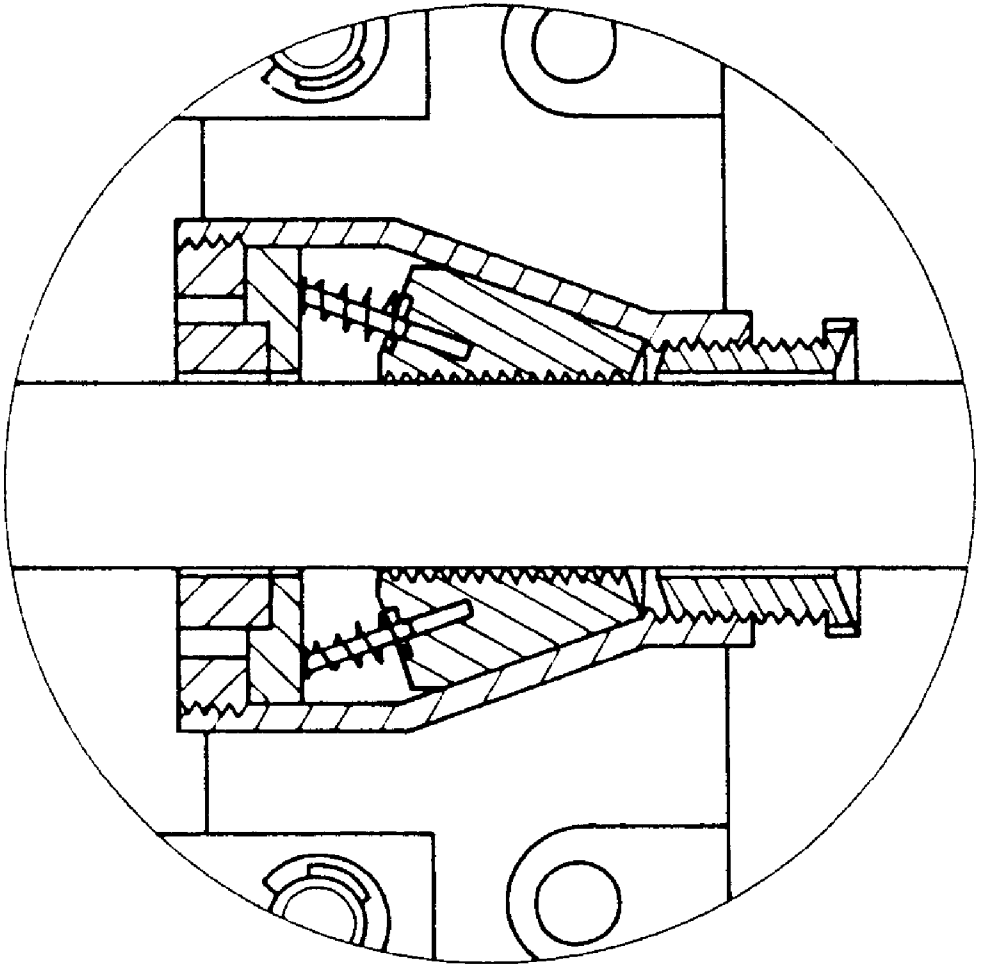
FIG. 6A is a second sectional view of a second uplifter.
Figure 7:
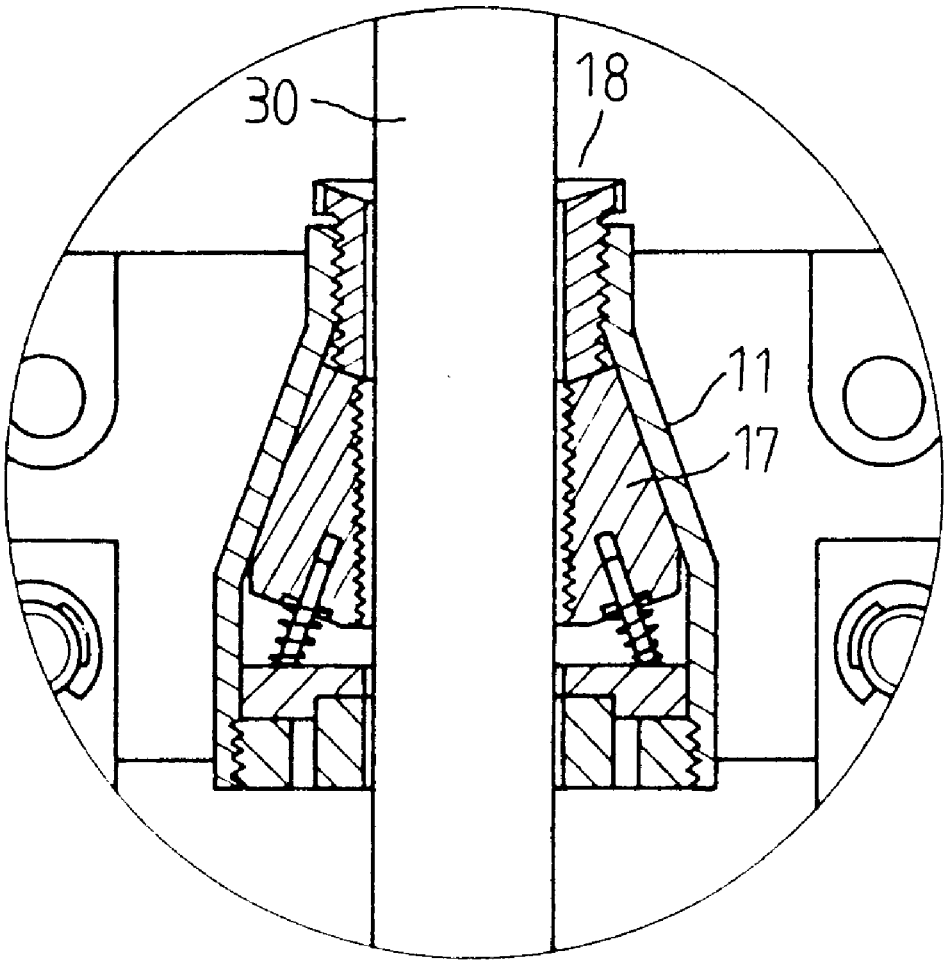
FIG. 7 is a third sectional view of a second uplifter.

Referring to FIGS. 6 and 6A, the cylinders 20 drive the shafts 21 to retract and to drive the second uplifter 10A to descend. While the second uplifter 10A descends, the catch blocks 17 catch the rod 30 tightly. The tapered shapes of the catch blocks 17 will allow the catch blocks 17 to catch the rod 30 tightly. The embossed stripes 171 will not allow the uplifters 10 to fall down.

The first hollow barrel 11 of the first uplifter 10 moves upward. The locking seat 13 presses the ring 14. While the first uplifter 10 moves upward, the catch blocks 17 moves downward slightly. Then the catch blocks 17 will not catch the rod 30, but the catch blocks 17 contacts the rod 30 slightly. Therefore, the cross bars 33, pillars 34. The uplift assembly is positioned by two the longitudinal pillars 34, and the mold plate 35 moves upward.

The invention is not limited to the above embodiment but various modification thereof may be made. Further, various changes in form and detail may be made without departing from the scope of the invention.

I claim:

1. An uplift assembly comprises:

a first uplifter, a second uplifter, a rod enclosed by the first uplifter and the second uplifter, a first positioning plate connected to the first uplifter, a second positioning plate connected to the second uplifter, a first clamping plate clamping the first positioning plate, a second clamping plate clamping the first positioning plate, a third clamping plate clamping the second positioning plate, a fourth clamping plate clamping the second positioning plate, a first cylinder disposed between the first clamping plate and the third clamping plate, a second cylinder disposed between the second clamping plate and the fourth clamping plate, and a base plate disposed beneath the first clamping plate, the second clamping plate and the first uplifter, each of the first and the second positioning plates having a plurality of round holes, a first annular adjustment device disposed on the first cylinder, a second annular adjustment device disposed on the second cylinder, four support bars disposed on four corners of the base plate, a top plate disposed on the support bars, the top plate having a through hole to receive the rod, the base plate having a center hole to receive a pipe, a first shaft disposed in the first cylinder to be connected to the first clamping plate, a second shaft disposed in the second cylinder to be connected to the second clamping plate, each of the first and the second uplifters having a first hollow barrel, a plurality of inner threads formed in an upper portion of the first hollow barrel, a tapered wall formed in a middle portion of the first hollow barrel, a plurality of internal threads formed in a lower portion of the first hollow barrel, a plurality of catch blocks disposed in an inner periphery of the first hollow barrel, a plurality of springs disposed beneath the corresponding catch blocks respectively, a ring disposed beneath the springs, and a locking seat disposed in the lower portion of the first hollow barrel to support the ring, each of the catch blocks having a tapered periphery to match the corresponding tapered wall, a plurality of positioning posts disposed on the ring to be passed through the corresponding springs respectively and to be inserted in the corresponding catch blocks respectively, the locking seat having a collar, a plurality of through apertures, and a plurality of external threads engaging with the internal threads of the first hollow barrel, a hollow sleeve disposed on the first hollow barrel, and the hollow sleeve having a notched flange and a plurality of outer threads engaging with the inner threads of the first hollow barrel.

2. An uplift assembly as claimed in claim 1, wherein each of the catch blocks has a plurality of embossed stripes.

* * * * *